US007353908B1

(12) United States Patent
French

(10) Patent No.: US 7,353,908 B1
(45) Date of Patent: Apr. 8, 2008

(54) METHOD AND SYSTEM FOR ATTENUATING NOISE FROM A CABINET HOUSING COMPUTER EQUIPMENT

(75) Inventor: F. William French, Harvard, MA (US)

(73) Assignee: EMC Corporation, Hopkinton, MA (US)

( * ) Notice: Subject to any disclaimer, the term of this patent is extended or adjusted under 35 U.S.C. 154(b) by 251 days.

(21) Appl. No.: 10/945,831

(22) Filed: Sep. 21, 2004

(51) Int. Cl.
*F01N 1/06* (2006.01)
*G10K 11/178* (2006.01)

(52) U.S. Cl. ..... 181/206; 381/71.1; 381/71.2; 381/71.3; 381/71.5

(58) Field of Classification Search ..... 181/206; 381/71.1, 71.2, 71.3, 71.5
See application file for complete search history.

(56) References Cited

U.S. PATENT DOCUMENTS 4,122,303 A * 10/1978 Chaplin et al. ..... 381/71.8
5,010,576 A * 4/1991 Hill ..... 381/71.9
5,046,103 A * 9/1991 Warnaka et al. ..... 381/71.5
5,097,923 A * 3/1992 Ziegler et al. ..... 181/206
5,448,645 A * 9/1995 Guerci ..... 381/71.14
5,511,127 A * 4/1996 Warnaka ..... 381/71.5
5,828,768 A * 10/1998 Eatwell et al. ..... 381/333
5,995,632 A * 11/1999 Okada ..... 381/71.3
6,188,770 B1 * 2/2001 Okada ..... 381/71.3
6,481,527 B1 * 11/2002 French et al. ..... 181/201

* cited by examiner

*Primary Examiner*—Lincoln Donovan
*Assistant Examiner*—Jeremy Luks
(74) *Attorney, Agent, or Firm*—Krishnendu Gupta; Scott A. Quellette

(57) ABSTRACT

An apparatus for attenuating noise emanating from a cabinet housing noise-generating equipment includes a frame including at least one support member configured to be mountable on the cabinet, proximate the noise-generating equipment, at least one noise attenuation device mounted to each support member proximate the noise-generating equipment, the at least one noise attenuation device comprising a sound input device for receiving a noise signal output from the noise-generating equipment, a processing device for determining characteristics of the noise signal and generating a cancellation signal which is identical to the noise signal but approximately 180 degrees out-of-phase with the noise signal, and a sound output device for outputting the cancellation signal proximate the noise-generating equipment, to attenuate the noise emanating from the cabinet; and a noise absorption member mounted on each support member, the noise absorption members define surfaces that form sides of airflow channels through the apparatus.

17 Claims, 8 Drawing Sheets

METHOD AND SYSTEM FOR ATTENUATING NOISE FROM A CABINET HOUSING COMPUTER EQUIPMENT

FIELD OF THE INVENTION

The present invention is directed generally to a method and system for attenuating noise from a cabinet housing computer equipment and, more particularly, to a method and system for attenuating noise from a cabinet housing computer equipment that utilizes an active noise cancellation system for attenuating low frequency noise.

BACKGROUND OF THE INVENTION

Some electronic cabinets store computer equipment such as circuit boards (e.g., processor boards, memory boards, networking boards, etc.), power supplies, disk drives, combinations thereof, and the like. A typical electronic cabinet has a fan assembly that moves air through an airflow pathway within the cabinet in order to remove heat generated by the equipment stored therein. Noise is a typical byproduct of the operation of the fan assembly. The amount of noise emanating from some fan assemblies, particularly from fan assemblies which include large fan motors or many fan motors, can be so substantial that the electronic cabinets storing those fan assemblies are not suitable for operating in an office environment.

Some businesses choose to locate electronic cabinets away from office areas in dedicated lab areas (e.g., separate rooms) so that the operation of the electronic cabinets does not interfere with the office areas. Often the lab areas provide a controlled environment (e.g., constant humidity and temperature, security, etc.) and provide convenient access to the cabinets (e.g., ceiling troughs and raised floors for power and network cables, space for adequate air circulation, etc.). Due to the large amount of noise typically emanating from the electronic cabinets in these areas, people who often spend a significant amount of time working in the vicinity (e.g., equipment operators, service technicians, etc.) typically wear earplugs or headphones to protect and preserve their hearing.

Proposed governmental regulations for limits on the allowable noise levels of machinery operating in both attended and unattended operating areas have forced designers of such equipment to develop machines that either generate less noise during operation or suppress any noise that is generated by the machines.

One electronic equipment manufacturer provides an electronic cabinet assembly having (i) a cabinet, (ii) a fan assembly located in the top of the cabinet, and (iii) a conventional noise muffling device that rests on top of the cabinet over the fan assembly in order to reduce noise emanating from the fan assembly. The noise muffling device is roughly a foot in height. The muffling device includes a grid of fiberglass padding and an outer steel housing that holds the grid over the fan assembly. A screened mesh retains the fiberglass in the grid configuration and prevents pieces of fiberglass from escaping into the air. The grid of fiberglass padding defines sets of flat sides which run parallel to the direction of the airflow pathway through the cabinet. When the fan assembly is in operation, some of the noise energy is absorbed by the grid of fiberglass thus reducing the amount of noise emanating from the cabinet.

SUMMARY OF THE INVENTION

Unfortunately, there are deficiencies to the above-described conventional muffling device. For example, in some situations, the muffling device does not adequately reduce noise emanating from the fan assembly. In particular, with the trend toward higher powered electronic components there comes the need for higher power airflow to cool those components. As such, the fan assemblies for many of the newer and larger cabinets generate such a significant amount of noise that the above-described conventional muffling device is no longer adequate to handle such situations.

Additionally, the height of the above-described conventional muffling device (e.g., roughly a foot) raises the profile of the cabinet assembly. The raised profile increases the required height of the ceiling in which the cabinet assembly resides, and may be less aesthetically pleasing than some conventional cabinet assemblies with lower profiles (e.g., conventional cabinet assemblies that do not have muffling devices).

Furthermore, the above-described conventional muffling device is rather heavy and expensive due to the steel housing that holds the fiberglass grid. The weight of the steel housing makes it difficult, particularly for shorter people, to install and remove the muffling device from the cabinet. The relative high cost of the steel housing may prohibit purchases of the muffling device even though the muffling device could substantially reduce the noise emanating from the cabinet assembly.

The above-described approach of using ear protection (e.g., earplugs or headphones) can provide effective protection to people working in the vicinity of the cabinet assembly. However, this approach cannot always be relied upon. For example, such ear protection items are cumbersome for a user to carry around, particularly if that user often enters and leaves the lab area, and are occasionally forgotten or not worn. Additionally, since such items are often construed as personal items and contact the user's ear and/or hair, such items typically are not shared among multiple users and thus are not always available to everyone. Rather, due to resource limitations (e.g., expense, inventory control, etc.), such items are often not made freely available to all people accessing the lab area, and people that access the lab area only occasionally are often made to endure the noise instead of being protected from it.

In contrast to the above-described conventional approach to reducing noise using a muffling device having a fiberglass grid that defines a set of flat sides running parallel to the direction of the airflow pathway through the cabinet, the invention is directed to techniques for attenuating noise from a computer equipment cabinet using a noise cancellation system which receives fan noise through microphones and transmits an identical, out-of-phase anti-sound wave through speakers mounted proximate the fans. The anti-sound waves cancel the fan sound wave, thereby eliminating the sound. In another embodiment of the invention, the noise cancellation system is used in combination with lateral noise absorption members which define surfaces that form sides of airflow channels therethrough. The surfaces are substantially non-parallel to a direction of an airflow pathway through the cabinet when the lateral noise absorption members are properly installed with the cabinet. Accordingly, the invention can provide substantial and superior ear protection particularly to people in the vicinity of the cabinet who do not have the benefit of other ear protection (e.g., earplugs, headphones, etc.).

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

The invention is directed to techniques for attenuating noise from a cabinet that houses computer equipment using a noise cancellation system which receives fan noise through microphones and transmits an identical, out-of-phase anti-sound wave through speakers mounted proximate the fans. The anti-sound waves cancel the fan sound wave, thereby eliminating the sound. In another embodiment of the invention, the noise cancellation system is used in combination with lateral noise absorption members which define surfaces that form sides of airflow channels therethrough. The surfaces are substantially non-parallel to a direction of an airflow pathway through the cabinet when the lateral noise absorption members are properly installed with the cabinet. Accordingly, the invention can provide substantial and superior ear protection particularly to people in the vicinity of the cabinet who do not have the benefit of other ear protection (e.g., earplugs, headphones, etc.).

Figure 1:
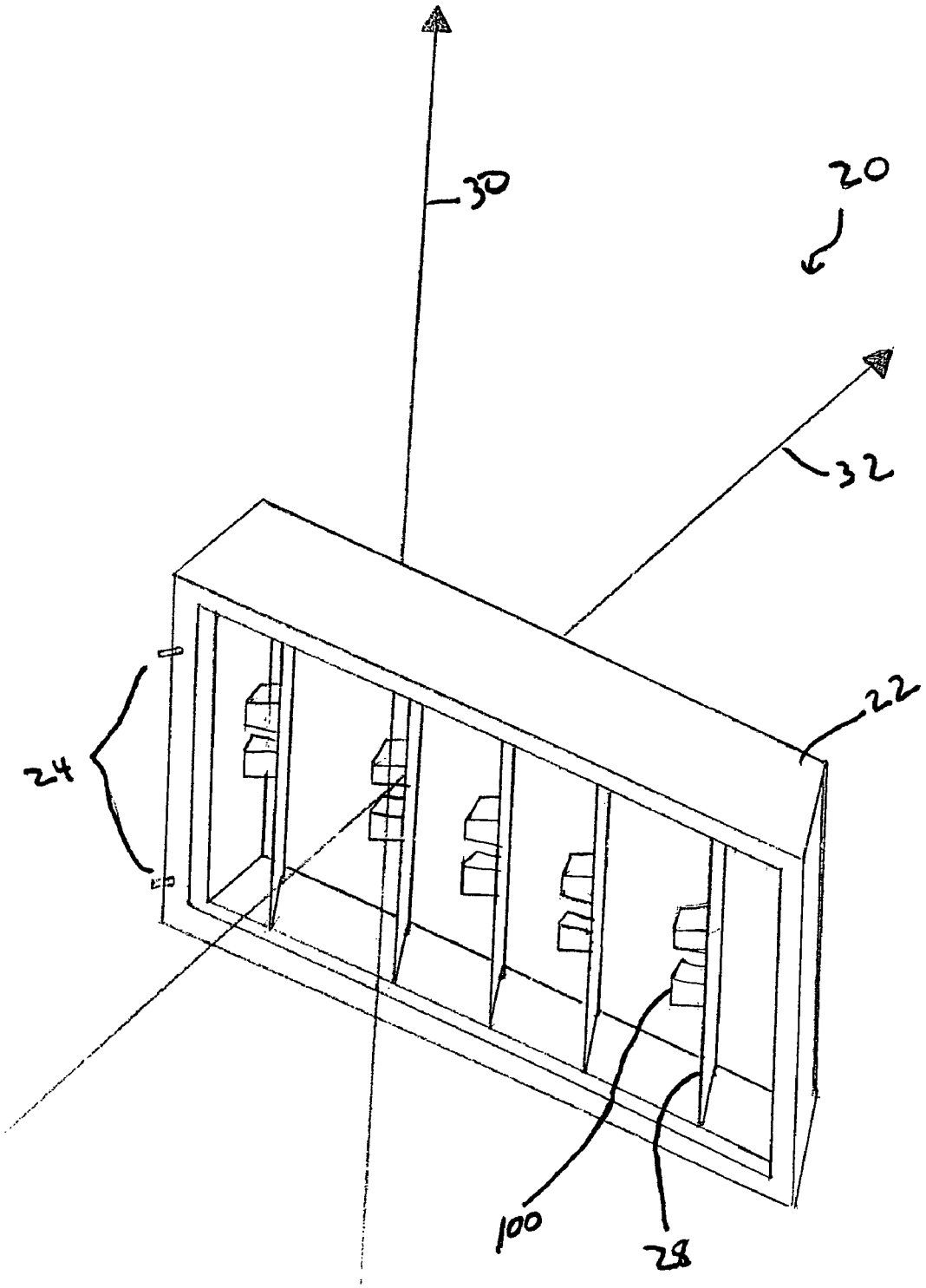
FIG. 1 shows a perspective view of an underside of an apparatus for attenuating noise which is suitable for use by the invention.

FIG. 1 shows an apparatus 20 which is suitable for use by the invention. The apparatus 20 includes a frame 22, a set of positioning members 24, and noise cancellation devices 100 that are supported by support members 28 of the frame 22. The set of positioning members 24 positions the frame 22 relative to a cabinet (shown in subsequent figures) that houses computer equipment so that the apparatus 20 attenuates noise from the cabinet. Support members 28 form sides of airflow channels 30 through the apparatus 20. Additionally, the support members 28 may be configured in a louvered manner within the apparatus 20 and support the noise cancellation devices 100 within the airflow channels 30. Preferably, the support members 28 are substantially non-parallel to a direction 32 of an airflow pathway through the cabinet when the set of positioning members 24 positions the frame 22 relative to the cabinet. Further details of the invention will now be described with reference to FIG. 2.

Figure 2:
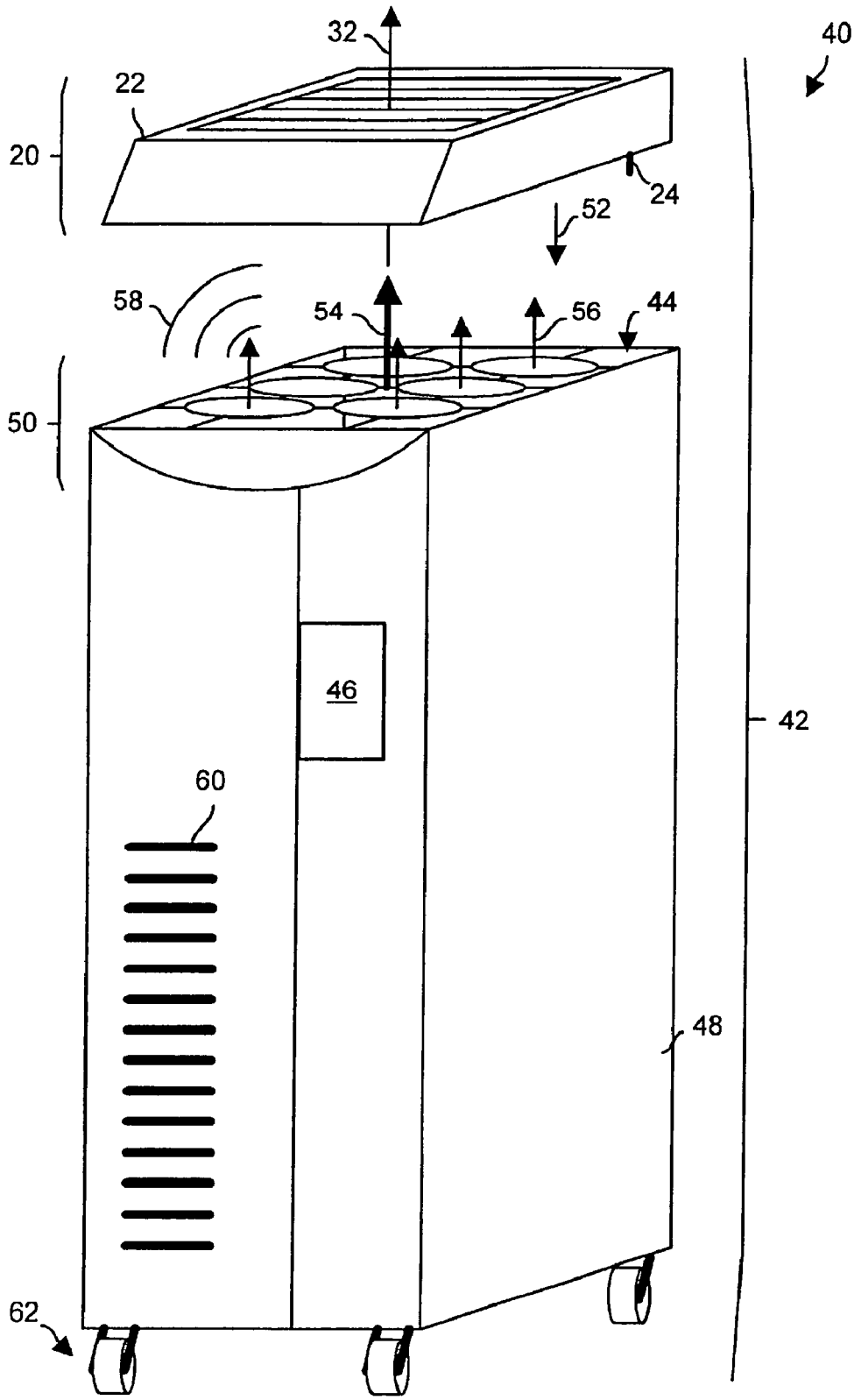
FIG. 2 shows a perspective view of a computer assembly which uses the apparatus of FIG. 1.

FIG. 2 shows a computer assembly 40 which includes, among other things, a cabinet assembly 42 and computer equipment 44 (shown generally by the arrow 44). Preferably, the computer assembly 40 further includes input/output (I/O) circuitry 46 such as a small control panel 46 (e.g., LEDs and/or buttons) which allow a user to monitor and/or operate the computer equipment 44 (e.g., observe operations, startup and/or shutdown the computer assembly 40, etc.).

The cabinet assembly 42 includes a cabinet 48, a fan assembly 50, and the apparatus 20 of FIG. 1. By way of example only, the fan assembly 50 is located at the top of the cabinet 48, and includes six fans arranged in a 2 by 3 array. The apparatus 20 rests on the top of the cabinet 48 over the fan assembly 50. In particular, the set of positioning members 24 (e.g., a set of metal alignment posts, also see FIG. 1) properly positions and holds the frame 22 of the apparatus 20 securely on the top of the cabinet 48.

The cabinet 48 includes an airflow pathway 54 (shown generally as the large arrow 54) that runs through the cabinet 48 along a direction 32 (also see FIG. 1). When the computer assembly 40 is an operation, the fan assembly 50 provides an air stream 56 (shown generally as multiple small arrows 56 in FIG. 2) that runs in the direction 32 of the airflow pathway 54. When the fan assembly 50 operates, the fan assembly 50 generates noise energy 58 (shown generally as curves 58) which emanates from the top of the cabinet 48.

It should be understood that the components of the computer assembly 40 can include other features. For example, the doors and/or sides of the cabinet 48 can define multiple air holes 60 which allow air to enter the cabinet 48. As another example, the cabinet assembly 42 can include a set of wheels 62 which raise the cabinet 48 above the floor in order to allow air to enter the cabinet through the bottom of the cabinet 48, and to allow the computer assembly 40 to be moved conveniently around on a floor. Further details of the invention will now be provided with reference to FIG. 3.

Figure 3:
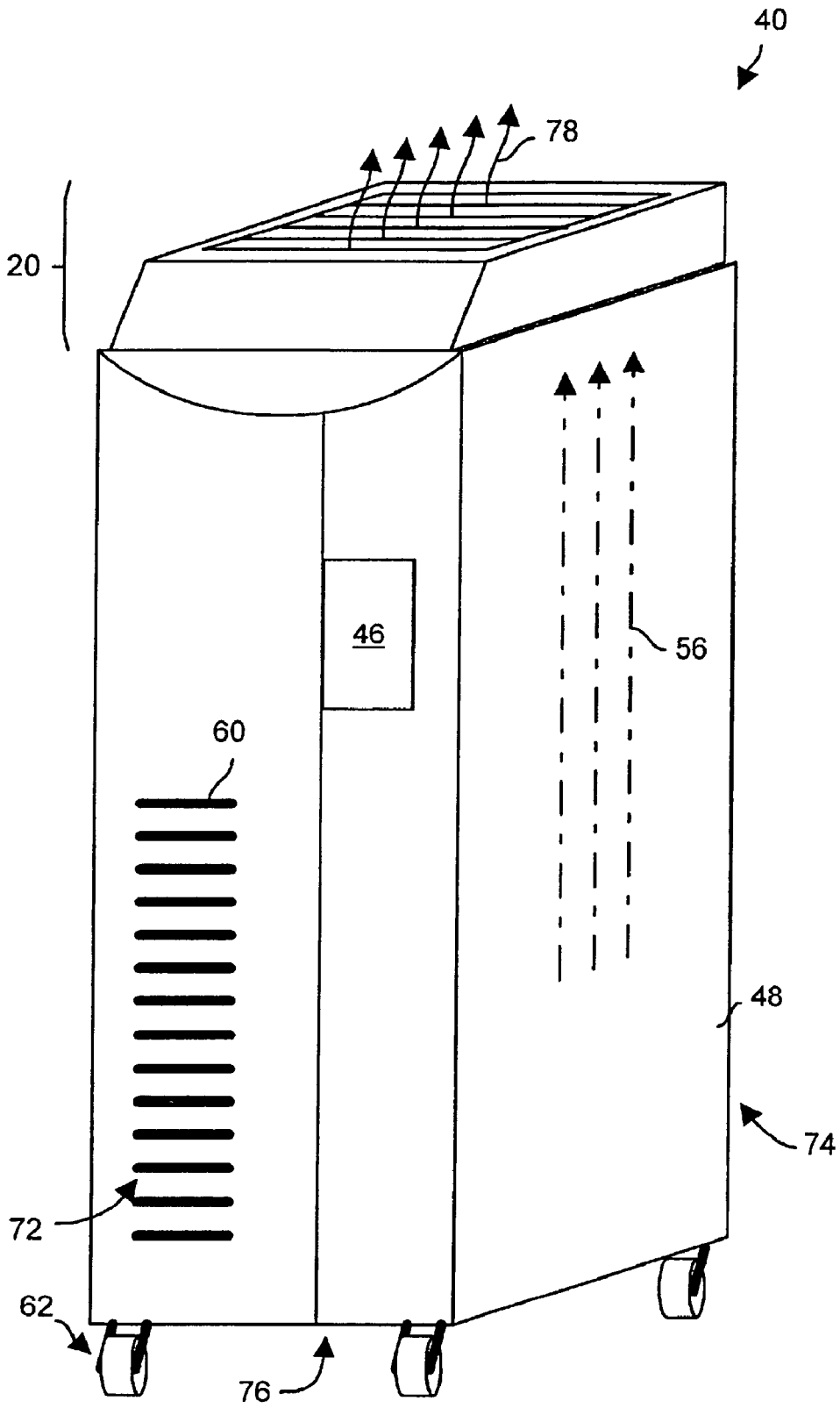
FIG. 3 shows a perspective view of the computer assembly of FIG. 2 when the apparatus is installed.

FIG. 3 shows the computer assembly 40 when the apparatus 20 is properly installed on top of the cabinet 48. When the computer assembly 40 is in operation, the fan assembly 50 generates the air stream 56 (illustrated by the dashed arrows 56) in the direction 32 of the airflow pathway 54 (see FIG. 2) in order to cool the computer equipment 44 stored within the cabinet 48. The fan assembly 50 draws air through air holes (e.g., air holes 60) in the front and back of the cabinet 48 (see arrows 72 and 74) and through the bottom of the cabinet 48 (see arrow 76). The air from the generated air stream 56 passes through the apparatus 20 (see arrows 78) thus removing heat from the operating computer equipment 44. Noise energy 58 emanating from the fan assembly 50 is attenuated by the apparatus 20 (see FIGS. 1 and 2) thus providing ear protection for people in the vicinity of the computer assembly 40. Further details of the invention will now be provided with reference to FIG. 4.

Figure 4:
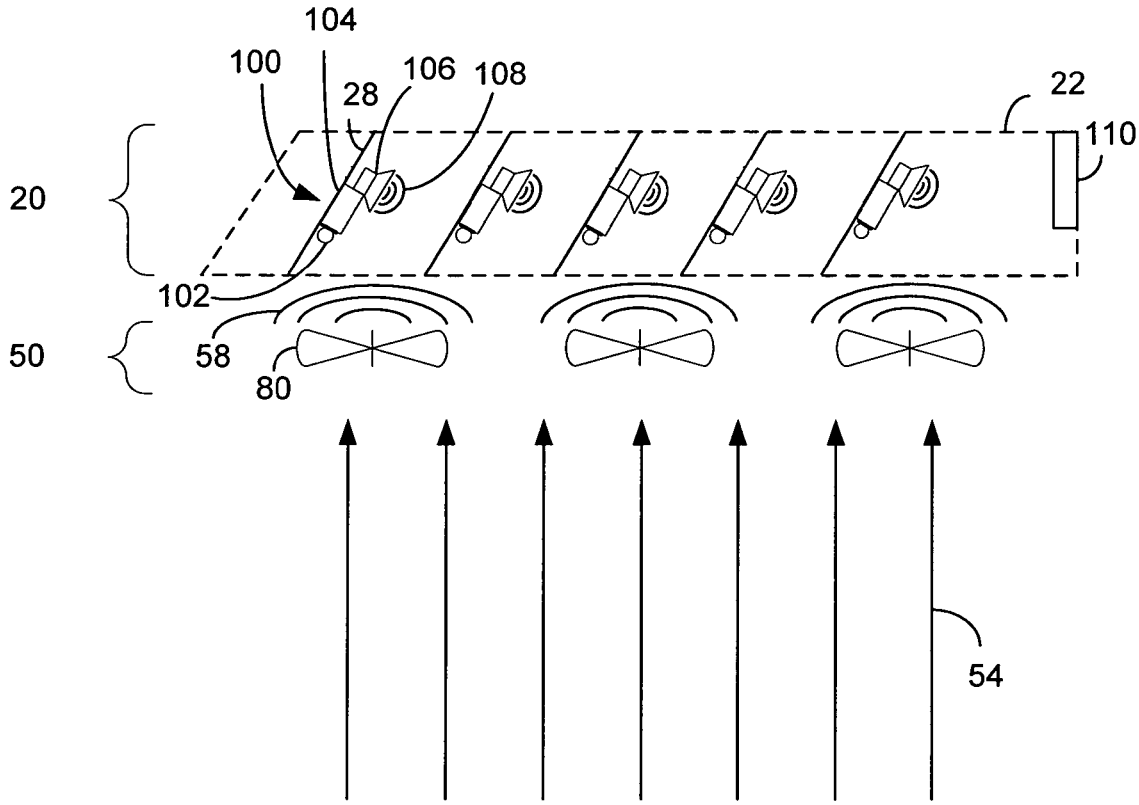
FIG. 4 shows a cross-sectional side view of one embodiment of the apparatus, in addition to particular components of the computer assembly of FIG. 3.

FIG. 4 shows a cross-sectional side view of one embodiment of the apparatus 20, with the frame 22 shown in phantom, when the apparatus 20 is properly installed over the fan assembly 50. In this embodiment, mounted to each support member 28 is a noise cancellation device 100. For simplicity, only one of the noise cancellation devices 100 will be described, but it will be understood that the noise cancellation devices 100 are preferably identical in design and operation. Each noise cancellation device 100 includes a microphone 102, a processing portion 104 and a speaker 106. Microphone 102 and speaker 106 are standard components and the specifications of which will depend on the particular noise attenuation requirements of the cabinet on which the apparatus 20 is mounted. As shown, the support members 26 of the apparatus 20 form the sides of airflow channels 30 through the apparatus. The support members 26 may be oriented at an angle, in a non-parallel manner, relative to the direction 32 of the airflow pathway 54 through the cabinet 48 (shown simply as arrows 54 in FIG. 5, also see FIG. 3). Alternatively, the support members may be oriented parallel to the direction 32 of the airflow pathway 54. Apparatus 20 also includes a power supply device 110, which provides power to each of the noise cancellation devices 100. Preferably, the power supply device 110 supplies power to the noise cancellation devices 100 separately from the power supply of the computer equipment 44 within the cabinet 48. This enables the apparatus to be retrofitted to the cabinet 48 without requiring a power connection between the apparatus 20 and the cabinet 48. In one embodiment, such as is shown in FIG. 1, each support member 28 has a single noise cancellation device 100 centrally mounted thereon. However, it will be understood that the number and placement of the noise cancellation devices 100 on each support member 28 may vary depending on the noise reduction requirements of the fan assembly over which the apparatus 20 is mounted.

As described above, the fan assembly 50 operates to provide an air stream 56 (FIG. 2) for the purpose of removing heat generated by the computer equipment 44 within the cabinet 48. Each fan 80 of fan assembly 50 generates noise energy 58 which emanates from the top of the cabinet. This noise energy is received by the microphone 102 of each noise cancellation device 100. Processing portion 104 receives the noise energy 58 from the microphone 102, generates an identical signal that is 180 degrees out-of-phase with the received noise energy 58 and outputs the generated signal 108 from speaker 106. The generated signal 108 cancels the noise signal 58 through destructive interference and greatly reduces the amount of noise energy 58 that is able to escape from the apparatus 20. The operation of the noise cancellation devices 100 is known in the art and will not be specifically described herein.

While the embodiment shown and described with reference to FIG. 4 is capable of attenuating noise energy generated by the fans 80 of fan assembly 50, known noise cancellation devices, such as devices 100 described above, are typically capable of attenuating only low-frequency noise, such as noise having a frequency of approximately 1 kHz or less. If the noise energy 58 received by the microphone 102 includes a component having a frequency greater than approximately 1 kHz, a complementary noise attenuating device that is capable of attenuating the higher-frequency noise would enable the apparatus to attenuate the broader frequency noise generated by the fan assembly 50.

Figure 5:
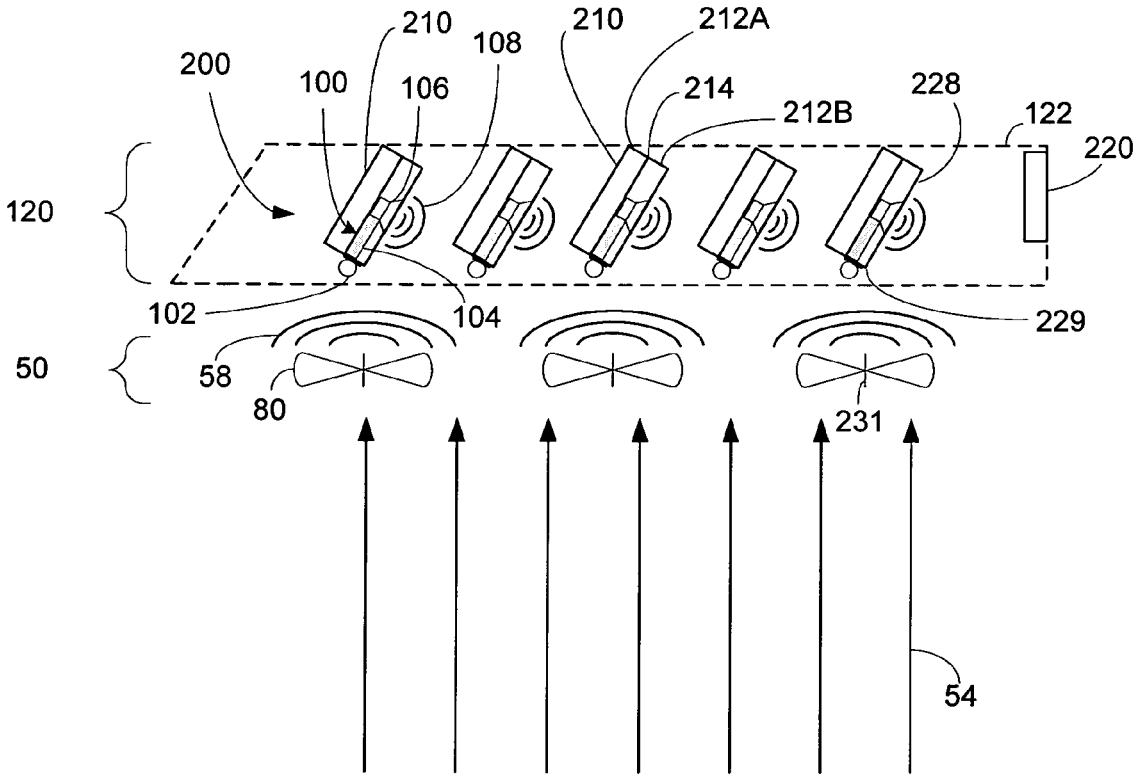
FIG. 5 shows a cross-sectional side view of another embodiment of the apparatus, in addition to particular components of the computer assembly of FIG. 3.

FIG. 5 shows a cross-sectional side view of another embodiment 120 of the apparatus, with the frame 122 shown in phantom, when the apparatus 120 is properly installed over the fan assembly 50. In this embodiment, the noise cancellation devices 100 are incorporated into noise absorption members 210 to form noise attenuation devices 200. With the exception of having noise cancellation devices 100 incorporated therein, apparatus 120 is identical to the apparatus described in U.S. Pat. No. 6,481,527, which is commonly owned with the present application, and which is incorporated herein by reference in its entirety.

Specifically, noise absorption members 210 each include a pair of rectangular-shaped foam portions 212A, 212B and a flexible support member 214 (e.g., a strip of flexible lightweight aluminum). The rectangular shapes of the foam portions 212 are easy and efficient to cut (e.g., there are no difficult angle cuts) thus enabling the task of manufacturing the foam portions 212 to remain simple and inexpensive.

An adhesive (e.g., a pressure sensitive adhesive) resides on the front and back surfaces of each flexible support member 214 in order to hold the foam portions 212A and 212B in place to form a lateral noise absorption member 210. The flexible support members 214 provide support for the foam portions 212 but enable the lateral noise absorption members 210 to bend for easy installation within the frame 122. The foam portions 212A which face away from the fan assembly 50 and form the top of the apparatus 20 help absorb noise energy that is reflected from the foam portion 212B of adjacent lateral noise absorption members 212. Accordingly, noise energy that is reflected by the lateral noise absorption members 212 can be absorbed by other later noise absorption members 212 rather than be allowed to escape.

Figure 6A:
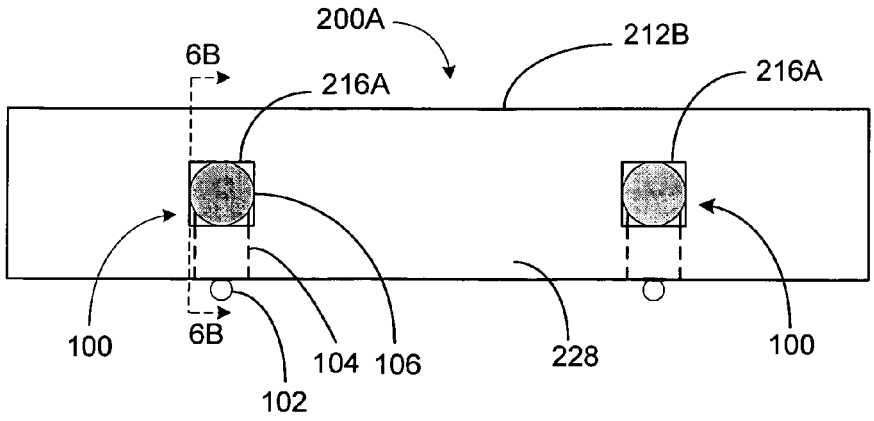
FIGS. 6A-6B show front and cross-sectional views, respectively, of the noise attenuation device of the embodiment of the apparatus shown in FIG. 4.
Figure 6B:
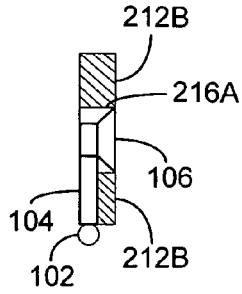

Noise cancellation devices 100 are mounted to the flexible support members 214. Preferably, a noise attenuation device 200 is positioned directly over each fan 80 of the fan assembly. Additional noise attenuation devices 200 may also be mounted to support members 214 in positions between the fans 80, as shown in FIG. 5. Typically, when the apparatus 120 is used in conjunction with a fan assembly 50 having a 2-by-3 configuration, each support member 214 will have two noise cancellation devices 100 mounted thereon, i.e., one noise cancellation device 100 for each row of fans. Regardless of the actual number of noise cancellation devices 100 mounted on each support member, the foam portions 212B are cut to accommodate the mounting of the noise cancellation devices 100 to the support members 214. FIG. 6A shows a front view of a first embodiment of a noise attenuation device 200A. In this embodiment, the noise cancellation device 100, including microphone 102, processing portion 104 and speaker 106, is mounted to the support member (not shown). The foam portion 212B includes cutouts 216A which accommodate the noise cancellation devices 100. As shown in FIG. 6B, which is a cross-sectional view of the noise attenuation device 200A as seen from line 6B-6B of FIG. 6A, cutout 216A comprises only the portion of foam portion 212B necessary to accommodate the noise cancellation device 100. In other words, the only exposed portion of the noise cancellation device 100 is the speaker. The remaining portion of the noise cancellation device 100 remains under the foam portion 212B. This embodiment maximizes the surface area of the foam portion 212B for the purpose of attenuating the noise energy.

Figure 7A:
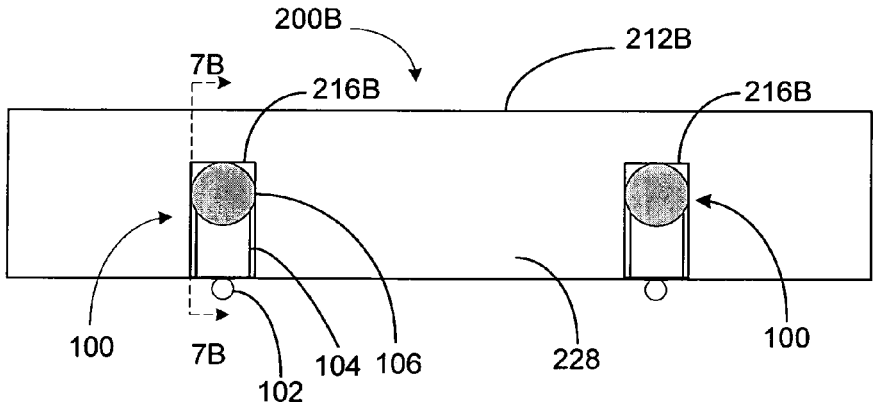
FIGS. 7A-7B show front and cross-sectional views, respectively, of the noise attenuation device of the embodiment of the apparatus shown in FIG. 5.
Figure 7B:
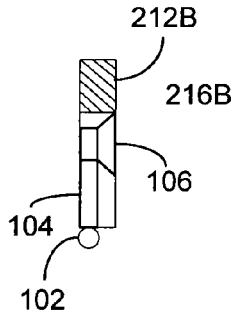

Alternatively, as shown in FIG. 7A, which is a front view of a first embodiment of a noise attenuation device 200B, and FIG. 7B, which is a cross-sectional view of the noise attenuation device 200B as seen from line 7B-7B of FIG. 7A, cutout 216B may comprise a portion of foam portion 212B that causes the entire noise cancellation device 100 to be exposed. While this embodiment does not provide as much surface area of the foam portion 212B for the purpose of attenuating the noise energy, it is easier to manufacture than the embodiment of FIG. 6.

As shown, the surfaces 228 of the lateral noise absorption members 210 of the apparatus 120 form the sides of airflow channels 30 through the apparatus. The lateral noise absorption members 210 are oriented at an angle, in a non-parallel manner, relative to the direction 32 of the airflow pathway 54 through the cabinet 48 (shown simply as arrows 54 in FIG. 5). In particular, the lateral noise absorption members 210 are oriented at substantially 30 degrees to the direction 32 of the airflow pathway 54. This orientation allows for sufficient airflow through the channels 30 and does not adversely affect the cooling capability of the air stream. Furthermore, this orientation provides the lateral noise absorption members 210 with an improved angle of incidence for absorption of noise energy 58 traveling in the direction 32 of the airflow pathway 54. That is, although the noise energy 58 may tend to emanate in all directions from each fan 114, a major component of the noise energy 58 along the direction 32 strikes the foam surfaces 28 of the lateral noise absorption members 210 and is converted into low level heat which is then removed via the air stream generated by the fan assembly 50. The improved angle of incidence provides superior noise energy absorption to that of the above-described conventional muffling device which has grid of fiberglass padding that defines sets of flat sides which run parallel to the direction of the airflow pathway through the cabinet.

Figure 8:
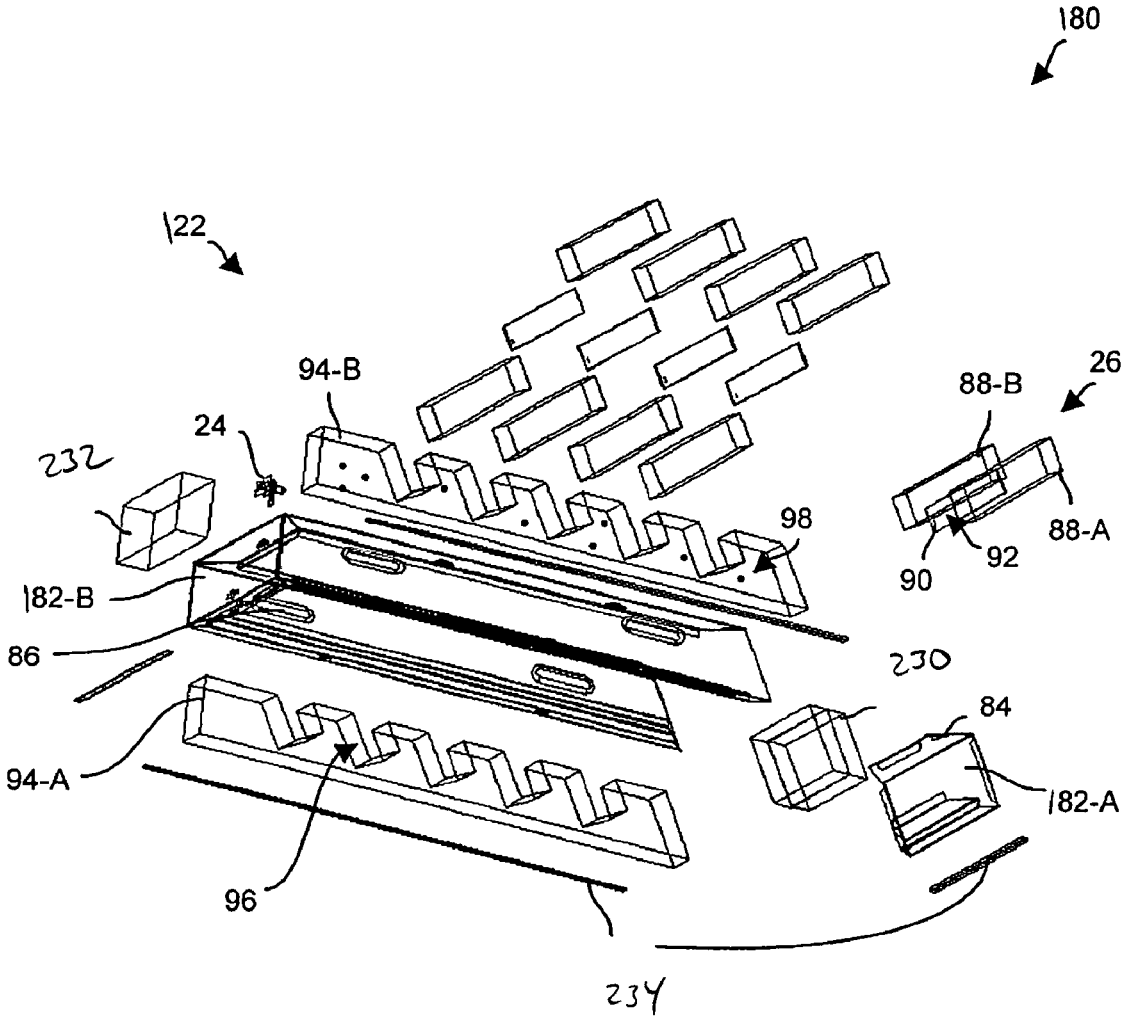
FIG. 8 shows an exploded view of the apparatus of FIG. 1.

FIG. 8 shows an exploded view 180 of the apparatus 120. As shown, the frame 122 includes a front portion 182-A and a back portion 182-B. Preferably, the front and back portions 182-A, 182-B are made of lightweight aluminum (e.g., 0.04 inch thick aluminum) and are welded together to form the frame 122. The lightweight aluminum makes the apparatus 120 lighter and easier to lift and install than the earlier-described conventional muffling device having the steel housing. Furthermore, the lightweight aluminum is less expensive than steel and thus reduces the cost of the apparatus 120 relative to the conventional muffling device. While the noise cancellation devices 100 and the foam portions 212B of the noise attenuation devices 200 are not specifically shown in FIG. 8, it will be understood that the noise attenuation devices 200 are formed as described above with reference to FIGS. 5-7.

The apparatus 120 includes additional components that reduce noise leakage through and around the apparatus 120. For example, the apparatus 120 further includes a pair of longitudinal noise absorption members 94-A, 94-B. Each longitudinal noise absorption member 94 defines a set of slots 96 for holding the ends of the lateral noise absorption members 210. The flexible support members 90 of the lateral noise absorption members 210 enable the lateral noise absorption members 210 to bend easily and install between slots 96 of the longitudinal noise absorption members 94.

Preferably, the surfaces 228 of the lateral noise absorption members 210 are flat in order to absorb noise energy but not to impede airflow through the apparatus 120. Each longitudinal noise absorption member 94 includes a flat foam portion that provides a similar flat surface (e.g., an embossed foam surface) that forms portions of the airflow channels 30 of the apparatus 120 (also see FIG. 1).

The apparatus 120 further includes a lateral front absorption member 230 (e.g., a pair of flat-surfaced foam portions) and a lateral rear absorption member 232 (e.g., another flat-surfaced foam portion). The apparatus 120 further includes a set of felt strips 234 which fasten along the edges of the frame 22. The front and rear members 230, 232 and the felt strips 234 enhance the noise attenuation properties of the apparatus 120 by reducing noise leakage through and around the apparatus 120.

It should be understood that the apparatus 120 does not absorb all of the noise energy 58. Rather, some of the noise energy 58 penetrates the lower foam portions 212B, strikes the support members 214 and reflects back. This reflected noise energy is then either absorbed by the lower foam portions 212B on its way back or escapes. Some of the escaping noise energy may be reflected back to the source, i.e., the fan assembly 50. Furthermore, some of the noise energy is absorbed by the upper foam portions 212A and converted into low level heat. Accordingly, a substantial amount of the noise energy 58 can be absorbed by the apparatus 20 or reflected back rather than be allowed to escape from the computer assembly 40.

It should be understood that the longitudinal noise absorption members 94 (see FIG. 8) position the lateral noise absorption members 210 such that an edge 229 of each lateral noise absorption member 210 may reside over an axis of rotation 231 of at least one fan 80. That is, the centerlines of the fans 80 align with the lower corner edges 229 of the lateral noise absorption members 210. This placement of the lateral noise absorption member edges 229 over the axes of rotation 231 of the fans 80 results in very little disruption of the airflow provided by the fans 80 in order to avoid substantially interfering with the air stream.

Figure 9:
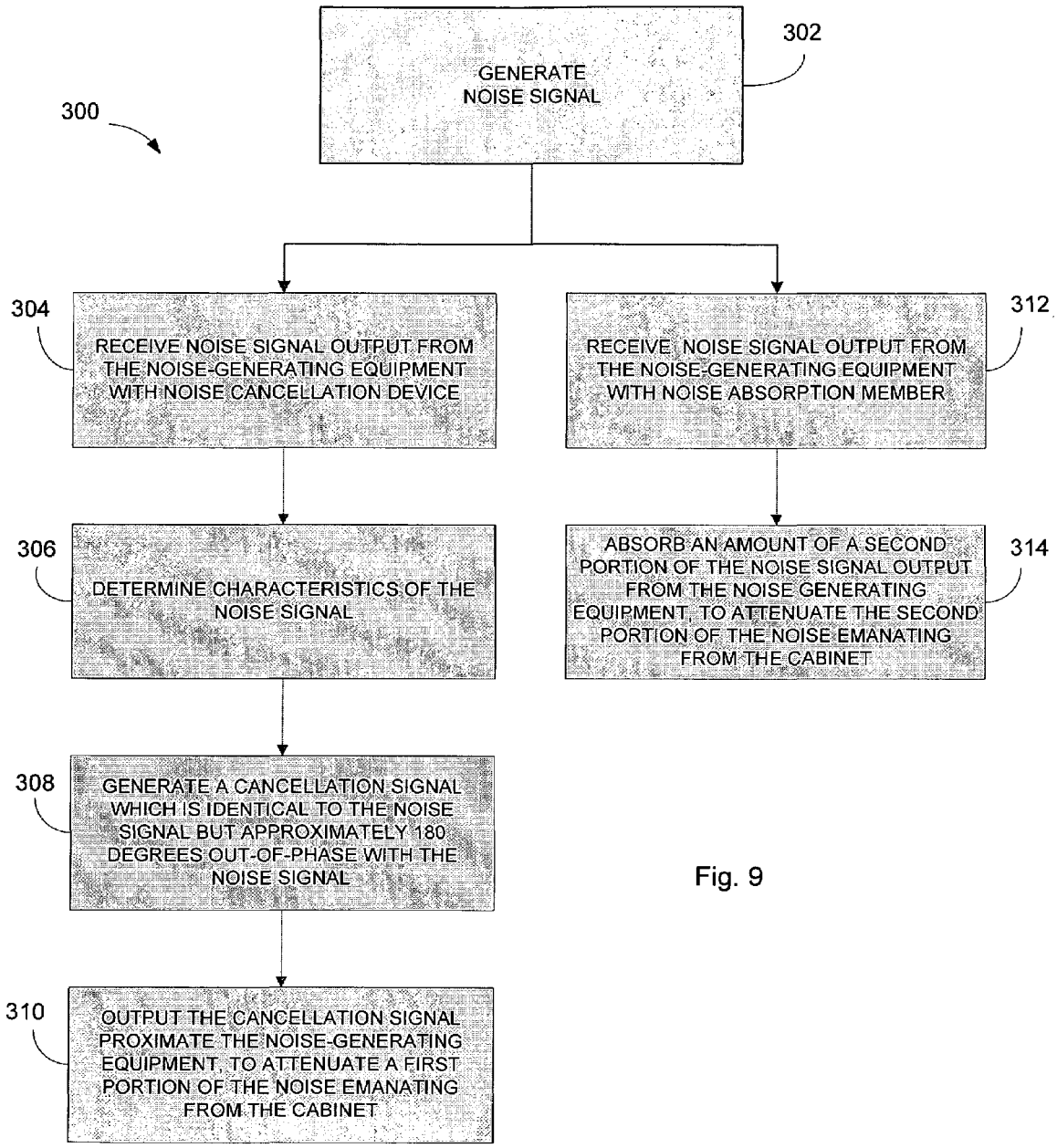
FIG. 9 is a flow diagram showing the steps involved in the operation of the apparatus shown in FIG. 5.

FIG. 9 is a flow diagram 300 that shows steps involved in the method of attenuating noise emanating from the cabinet in accordance with the present invention. In Step 302, a noise signal is generated by the noise-generating computer equipment 40 housed within the cabinet 48. Steps 304 through 310 occur continuously and concurrently with Steps 312 through 314. In Step 304, the noise signal is received by the microphone 102 of the noise cancellation device 100. The processing portion 104 of the noise cancellation device 100 determines characteristics of the noise signal, Step 306, and generates a cancellation signal which is identical to the noise signal, but approximately 180 degrees out-of-phase with the noise signal, Step 308. The cancellation signal is then output from the speaker 106 to attenuate a first portion of the noise emanating from the cabinet, Step 310. As described above, the first portion of the noise is the relatively low-frequency portion, i.e. the portion of the noise having a frequency of approximately 1 kHz or less. In Step 312, the noise signal is received by the noise absorption members 210. The noise absorption members 210 absorb an amount of a second portion of the noise signal, to attenuate the second portion of the noise emanating from the cabinet 48, Step 314. As described above, the second portion of the noise is the relatively high-frequency portion, i.e. the portion of the noise having a frequency greater than approximately 1 kHz.

As described above, the invention is directed to techniques for attenuating noise energy 58 from a cabinet 48 that houses computer equipment 44 using noise cancellation devices 100 and noise absorption members 210. The noise cancellation devices 100 receive the noise energy 58 and generate a cancellation signal that attenuates the low-frequency portion of the noise energy 58. The surfaces 228 of the noise absorption members 210 are substantially non-parallel to a direction 32 of an airflow pathway 54 through the cabinet 48 when the lateral noise absorption members 26 are properly installed with the cabinet 48. The noise absorption members 210 absorb an amount of the high-frequency portion of the noise energy 58. Accordingly, the invention can provide substantial ear protection particularly to people in the vicinity of the cabinet who do not have the benefit of other ear protection (e.g., earplugs, headphones, etc.). The features of the invention, may be employed in computer systems, assemblies and procedures such as those of EMC Corporation of Hopkinton, Mass.

While this invention has been particularly shown and described with references to preferred embodiments thereof, it will be understood by those skilled in the art that various changes in form and details may be made therein without departing from the spirit and scope of the invention as defined by the appended claims.

For example, the fan assembly 50 and the apparatus 20 were shown as residing at the top of the cabinet 48 (see FIGS. 2 and 3) by way of example only. It should be understood that other locations for the fan assembly and the apparatus 20 are suitable as well. For example, the fan assembly 50 could be located at the bottom of the cabinet 48 rather than the top and push (rather than draw) air through the cabinet 48. As another alternative, the fan assembly 50 could be oriented such that the direction of airflow through the cabinet 48 is sideways. In such alternative arrangements, the apparatus 20 can be positioned in alternative locations (e.g., on the side or bottom) to attenuate noise energy 58 escaping from the alternatively configured and/or located fan assembly 50.

Additionally, it should be understood that the angle of incidence described is by way of example only. It should be understood that other angles are suitable as well. In particular, angles that are substantially non-parallel to the direction 32 of the airflow pathway 54 (e.g., 30 degrees, 45 degrees, or other angles in ranging between 10 degrees to 80 degrees) greatly facilitate noise absorption by the lateral noise absorption members 26 of the apparatus 20.

Additionally, it should be understood that the fan assembly 50 was described as having a 2-by-3 array of fans by way of example only. Other fan configurations are suitable as well such as a single large fan, two fans, etc.

Furthermore, it should be understood that the noise absorption members 26, 94, 230, 232 (see FIG. 8) where described as including foam portions by way of example only. Foam portions are well suited for the apparatus 20 due to their noise absorption properties, low cost, and easy handling attributes. In particular, foam can be easily cut and shaped (e.g., cut into rectangular portions, cut in order to define slots 96 as shown in FIG. 8, etc.) with little mess and waste thus keeping manufacturing costs minimal. Nevertheless, other materials are also suitable for use as well such as cotton, styrofoam, fiberglass, any combinations thereof, and the like.

The invention may be embodied in other specific forms without departing from the spirit or essential characteristics thereof. The present embodiments are therefore to be considered in respects as illustrative and not restrictive, the scope of the invention being indicated by the appended claims rather than by the foregoing description, and all changes which come within the meaning and range of the equivalency of the claims are therefore intended to be embraced therein.

The invention claimed is:

1. An apparatus for attenuating noise emanating from a cabinet housing a noise-generating fan for creating an airflow through the cabinet, the apparatus comprising:

a noise cancellation device including:

means for receiving a first portion of a noise signal output from the fan;

means for determining characteristics of the noise signal;

means for generating a cancellation signal which is identical to the noise signal but approximately 180 degrees out-of-phase with the noise signal; and means for outputting the cancellation signal proximate the noise-generating equipment, to attenuate noise emanating from the cabinet; and means for absorbing an amount of the second portion of the noise signal output from the fan, to attenuate the noise emanating from the cabinet;

wherein the means for absorbing an amount of the second portion of the noise signal includes a noise absorption member including a foam portion mounted on a support member, the foam portion having a first surface substantially non-parallel to a direction of an airflow pathway through the cabinet from the fan, such that the noise impinges the first surface of the foam portion of the noise absorption member; and wherein the noise cancellation device is mounted on the support member of the absorbing means within a void in the foam portion and arranged such that the means for determining characteristics of the noise signal, the means for generating the cancellation signal and the means for outputting the cancellation signal are disposed within the void, between the support member and the first surface of the foam portion;

the means for outputting the cancellation signal having a surface, distal from the support member, that is approximately aligned with a plane defined by the first surface of the foam portion to minimize any effect of the noise cancellation device on the airflow through the cabinet.

2. A apparatus for attenuating noise emanating from a cabinet housing noise-generating equipment, the apparatus comprising:

a frame configured to be mountable on the cabinet, proximate the noise-generating equipment, the frame including a support member;

a noise cancellation device mounted to the support member proximate the noise-generating equipment, the noise cancellation device comprising a sound input device for receiving a noise signal output from the noise-generating equipment, a processing device for determining characteristics of the noise signal and generating a cancellation signal which is identical to the noise signal but approximately 180 degrees out-of-phase with the noise signal, and a sound output device for outputting the cancellation signal proximate the noise-generating equipment, to attenuate the noise emanating from the cabinet; and a noise absorption member for absorbing the noise signal output from the noise-generating equipment, the noise absorption member being mounted on a first side of the support member, an outer surface of the noise absorption member being substantially non-parallel to a direction of an airflow pathway through the cabinet, and defining a flow path through the apparatus;

wherein the noise cancellation device is incorporated into the noise absorption member to minimize obstructions in the flow path of the apparatus.

3. The apparatus of claim 2 wherein the noise absorption members include foam portions to absorb portions of the noise signal exiting the cabinet in the direction of the airflow pathway.

4. The apparatus of claim 3 wherein the noise absorption members absorb relatively high frequency portions of the noise signal and the noise cancellation devices attenuate relatively low frequency portions of the noise signal.

5. The apparatus of claim 2 wherein the noise cancellation device is mounted on the support member within a void in the noise absorption member and arranged such that the processing device and the sound output device are disposed within the void, between the support member and the outer surface of the foam portion.

6. The apparatus of claim 5 wherein the sound output device has a surface, distal from the support member, that is approximately aligned with a plane defined by the outer surface of the noise absorption member to minimize obstructions in the flow path of the apparatus.

7. The apparatus of claim 2 wherein the noise absorption member further includes a second foam portion attached to a second side of the support member.

8. The apparatus of claim 2 wherein the sound input device comprises a microphone.

9. The apparatus of claim 2 wherein the sound output device comprises an audio speaker.

10. An apparatus for attenuating noise emanating from a cabinet housing noise-generating equipment, the apparatus comprising:

a frame configured to be mountable on the cabinet, proximate the noise-generating equipment, the frame including a support member, a noise cancellation device mounted to the support member proximate the noise-generating equipment, the noise cancellation device comprising a sound input device for receiving a noise signal output from the noise-generating equipment, a processing device for determining characteristics of the noise signal and generating a cancellation signal which is identical to the noise signal but approximately 180 degrees out-of-phase with the noise signal, and a sound output device for outputting the cancellation signal proximate the noise-generating equipment, to attenuate the noise emanating from the cabinet; and a noise absorption member for absorbing the noise signal output from the noise-generating equipment, the noise absorption member being mounted on the support member, an outer surface of the noise absorption member being substantially non-parallel to a direction of an airflow pathway through the cabinet, and defining a flow path through the apparatus;

wherein the noise cancellation device is incorporated into the noise absorption member to enable substantially all of the outer surface of the noise absorption member to absorb the noise signal.

11. The apparatus of claim 10 wherein the noise absorption members include foam portions to absorb portions of the noise signal exiting the cabinet in the direction of the airflow pathway.

12. The apparatus of claim 11 wherein the noise absorption members absorb relatively high frequency portions of the noise signal and the noise cancellation devices attenuate relatively low frequency portions of the noise signal.

13. The apparatus of claim 10 wherein the noise cancellation device is mounted on the support member within a void in the noise absorption member and arranged such that the processing device and the sound output device are disposed within the void, between the support member and the outer surface of the foam portion.

14. The apparatus of claim 13 wherein the sound output device has a surface, distal from the support member, that is approximately aligned with a plane defined by the outer surface of the noise absorption member to minimize obstructions in the flow path of the apparatus.

15. The apparatus of claim 10 wherein the noise absorption member further includes a second foam portion attached to a second side of the support member.

16. The apparatus of claim 10 wherein the sound input device comprises a microphone.

17. The apparatus of claim 10 wherein the sound output device comprises an audio speaker.

* * * * *